US006223915B1

(12) United States Patent
Waner

(10) Patent No.: US 6,223,915 B1
(45) Date of Patent: May 1, 2001

(54) APPARATUS FOR SECURELY RETAINING A PLURALITY OF GARMENT HANGERS

(75) Inventor: John Waner, Redmond, WA (US)

(73) Assignee: International Retail Services Group Inc., Woodinville, WA (US)

( * ) Notice: Subject to any disclaimer, the term of this patent is extended or adjusted under 35 U.S.C. 154(b) by 0 days.

(21) Appl. No.: 09/251,114

(22) Filed: Feb. 16, 1999

(51) Int. Cl.[7] ..... E05B 73/00

(52) U.S. Cl. ..... 211/124; 211/7; 211/204; 403/297

(58) Field of Search ..... 211/124, 123, 211/204, 7; 248/316.8; 403/294, 326, 327

(56) References Cited

U.S. PATENT DOCUMENTS

| | | | | |
|---|---|---|---|---|
| 744,819 | | 11/1903 | Thomas . | |
| 1,233,576 | | 7/1917 | Higgins . | |
| 1,375,553 | | 4/1921 | Brazeau . | |
| 1,432,589 | | 10/1922 | Brazeau . | |
| 1,695,517 | | 12/1928 | Waldbauer . | |
| 1,728,919 | | 9/1929 | Batts . | |
| 1,793,035 | * | 2/1931 | Whitney | 211/123 |
| 2,068,451 | | 1/1937 | Elmore | 211/124 |
| 2,276,659 | | 3/1942 | Kreisinger | 122/371 |
| 2,685,962 | | 8/1954 | Druth | 206/7 |
| 2,868,390 | | 1/1959 | McCrone | 211/124 |
| 3,021,958 | | 2/1962 | Winkler | 211/124 |
| 3,112,027 | | 11/1963 | Field et al. | 206/7 |
| 3,283,914 | | 11/1966 | Robinson | 211/123 |
| 3,298,503 | | 1/1967 | Field et al. | 206/7 |
| 3,306,465 | | 2/1967 | Brennan | 211/124 |
| 3,317,055 | | 5/1967 | Roscicki | 211/124 |
| 3,419,154 | | 12/1968 | Shapiro et al. | 211/7 |
| 3,458,051 | | 7/1969 | Zeman et al. | 211/124 |
| 3,472,385 | | 10/1969 | Shapiro et al. | 211/7 |

(List continued on next page.)

FOREIGN PATENT DOCUMENTS

| | | |
|---|---|---|
| 176150 | 9/1953 | (AT) . |
| 1 299 385 | 7/1969 | (DE) . |
| 40 38 336 C2 | 2/1992 | (DE) . |
| 43 27 381 A1 | 2/1995 | (DE) . |
| 894811 | 4/1962 | (GB) . |
| 2 033 741 | 5/1980 | (GB) . |
| 2 044 094 | 10/1980 | (GB) . |

*Primary Examiner*—Daniel P. Stodola
*Assistant Examiner*—Erica B. Harris
(74) *Attorney, Agent, or Firm*—Seed IP Law Group PLLC

(57) ABSTRACT

Apparatus for securely retaining hangers includes a hanger bar, a retainer bar, and a pair of end assemblies. Each end assembly is coupled to an end of the hanger bar and has a pair of guide walls projecting away from the hanger bar to form a guide channel. The retainer bar is slideably disposed and moveable within the guide channel between an open position and a clamping position to engage and secure the hangers to the hanger bar. A latching mechanism is attached to each end assembly and is engageable with the retainer bar to secure the retainer bar in the clamping position. The latching mechanism is preferably at least partially disposed between the guide walls to protect the latching mechanism from accidental bumping, thereby reducing unintentional disengagement of the latching mechanism. The apparatus can include at least one biasing member that urges the retainer bar away from the hanger bar to facilitate loading or unloading of the hanger bar. The apparatus can include an end assembly having a top wall extending between the guide walls to form a mechanical stop that limits the upward travel of the retainer bar away from the hanger bar, and providing additional protection for the latching tab a(gainst accidental bumping. The apparatus can further include a coupling member attached to each end of the retainer bar, the coupling members being engageable with the latching mechanism to engage and secure the retainer bar in the clamping position.

49 Claims, 6 Drawing Sheets

U.S. PATENT DOCUMENTS

| | | | |
|---|---|---|---|
| 3,519,139 | 7/1970 | Brennan | 211/124 |
| 3,581,905 | 6/1971 | Shapiro et al. | 211/7 |
| 3,610,423 | 10/1971 | Parillo | 211/7 |
| 3,613,898 | 10/1971 | Brennan | 211/124 |
| 3,868,906 | 3/1975 | Cameron | 104/89 |
| 3,921,814 | 11/1975 | Solomon | 211/162 |
| 4,037,728 | 7/1977 | Cameron | 211/124 |
| 4,079,840 | 3/1978 | Usner | 211/124 |
| 4,348,145 | 9/1982 | Marklund et al. | 414/288 |
| 4,494,896 | 1/1985 | DiFranco | 410/148 |
| 4,753,355 | 6/1988 | Hall et al. | 211/105.1 |
| 4,887,727 * | 12/1989 | Simmerman et al. | 211/124 |
| 5,092,473 * | 3/1992 | Zelniker | 211/124 |
| 5,251,767 * | 10/1993 | Wiederer | 211/124 |
| 5,509,542 | 4/1996 | Simmerman et al. | 211/124 |
| 5,683,195 * | 11/1997 | Liao | 403/102 |

* cited by examiner

APPARATUS FOR SECURELY RETAINING A PLURALITY OF GARMENT HANGERS

TECHNICAL FIELD

The present invention relates generally to apparatus for securely retaining a plurality of garment hangers for transport or storage such as those used, for example, in commercial settings relating to manufacturing, transporting, selling and distributing garments.

BACKGROUND OF THE INVENTION

Many garments are finished, transported, distributed and sold while mounted upon a hanger. Management of these hangers, particularly at the store distribution center and garment sales point is time consuming, distracting, and often creates a difficult storage problem. The typical triangular-shaped hanger, including a top hook, is simply an awkward article to handle. In quantity, the hangers tend to become entangled and are difficult to stack in any organized manner. Many stores handle a variety of shapes and sizes of hangers, further adding to the inconvenience.

It is known to use hanger storage assemblies for retaining and managing quantities of empty hangers. For example, FIG. 1 shows an existing hanger storage assembly disclosed by Hall et al in U.S. Pat. No. 4,753,355. The main components of this device include a hanger bar 11 that receives and supports a plurality of hangers 12, and a retainer bar 13. The retainer bar 13 is positionable adjacent to the hanger bar 11 to engage and secure a plurality of hooks 12*a* along the length of the hanger bar 11. The retainer bar 13 is typically a rigid channel member fitted with a strip 21 of resilient material (shown in FIG. 2) to accommodate and secure hangers 12 having differing diameters or configurations. Adjacent ends of the hanger bar 11 and the retainer bar 13 are coupled together by a vertical support member 15.

As best shown in FIG. 2, each vertical support member 15 includes a guide pin 16 that is rigidly fixed to the hanger bar 11 by means of a threaded bolt 16*a* that passes through apertures 17 in the hanger bar 11 and threads into internal threads in the guide pin 16. A spring 18 is disposed on the guide pin 16 between the hanger bar 11 and the retainer bar 13. The spring 18 biases the retainer bar 13 away from the hanger bar 11 to provide sufficient access to easily and conveniently load the hanger bar 11. A cap nut 20 is fitted to the guide pin 16 above the retainer bar 13 to limit travel of the retainer bar 13 away from the hanger bar 11.

The retainer bar 13 of the prior art hanger storage assembly is held into securing, hanger clamping engagement with the hooks 12*a* by means of a pair of latches 22, each of which includes a resilient tab 23 fixed to end caps 24 mounted on the hanger bar 11. The resilient tab 23 is biased against the end of the retainer bar 13 by a biasing force provided by the resilient characteristic of the tab material. The tab 23 engages the retainer bar with sufficient tension such that it holds the retainer bar 13 in position in opposition to, and overcoming the biasing spring 18 which tends to urge the retainer bar 13 away from the hanger bar 11. As best seen in FIG. 1, each end cap 24 is engaged by a bracket clip 27 that is mounted on a bracket base 28. The clips 27 match the polygonal shape of the end caps 24, preventing the hanger bar 11 from rotating out of useful alignment.

Although desirable results have been achieved, the prior art hanger storage assembly has several disadvantages. Inadvertent bumping or striking of the resilient tab 23 or the vertical support member 15 during use often causes the resilient tab 23 to unintentionally disengage from the retainer bar 13, thereby releasing the hangers. Also, because the vertical support member 15 penetrates through the hanger bar 11, manufacturing costs are increased because the apertures 17 must be drilled through the hanger bar 11. Manufacturing time and costs are further increased due to the need to threadedly engage the threaded bolt 16*a* and the cap nut 20 with the guide pin 16. Furthermore, the aesthetic appearance of the prior art assembly sometimes does not meet the standards of customers in the fashion-conscious garment industry.

SUMMARY OF THE INVENTION

The invention is directed toward apparatus for securely retaining a plurality of garment hangers. One embodiment of an apparatus in accordance with the invention includes a hanger bar, a retainer bar, and a pair of end assemblies. Each end assembly is coupled to an end of the hanger bar and has a pair of guide walls projecting away from the hanger bar to form a guide channel. The retainer bar is slideably disposed and moveable within the guide channel between a position away from the hanger bar (i.e. an open position) and a position near the hanger bar to engage and secure the hangers to the hanger bar (i.e. a clamping position). A latching mechanism is attached to each end assembly and is preferably at least partially disposed between the guide walls. The latching mechanism is engageable with the retainer bar when the retainer bar is in the clamping position. Manufacturing costs are reduced because there is no need to drill or machine the hanger bar, and because there are no threadedly engaging components to assemble. Furthermore, in a preferred embodiment, the end assembly protects the latching mechanism from accidental bumping, thereby reducing unintentional disengagement of the latching mechanism from the retainer bar.

In an alternate embodiment, an apparatus includes at least one biasing member that urges the retainer bar into the position away from the hanger bar to facilitate loading or unloading of the hanger bar. The biasing member permits the apparatus to be operated with one hand while the other hand handles the hangers.

In another alternate embodiment, an apparatus includes latching tabs that are resiliently biased against the retainer bar. The resiliently biased latching tabs promote ease of operation of the device.

In another alternate embodiment, an apparatus includes an end assembly having a top wall extending between the guide walls. The top wall forms a mechanical stop that limits the upward travel of the retainer bar away from the hanger bar, and provides additional protection for the latching tab against accidental disengagement.

In yet another alternate embodiment, an apparatus includes a coupling member attached to each end of the retainer bar. The coupling members slideably move between the guide walls of the end assemblies, escorting the retainer bar between the clamping position and the open position. Each coupling member is engageable with a latching mechanism to engage and secure the retainer bar in the clamping position.

DETAILED DESCRIPTION OF THE INVENTION

The present invention disclosure describes apparatus for securely retaining garment hangers in accordance with several embodiments of the invention. Specific details of certain embodiments of the invention are set forth in the following description, and in FIGS. 3–10, to provide a thorough understanding of such embodiments. A person of ordinary skill in the art, however, will understand that the present invention may have additional embodiments, and that the invention may be practiced without several of the details described in the following description.

Figure 1:
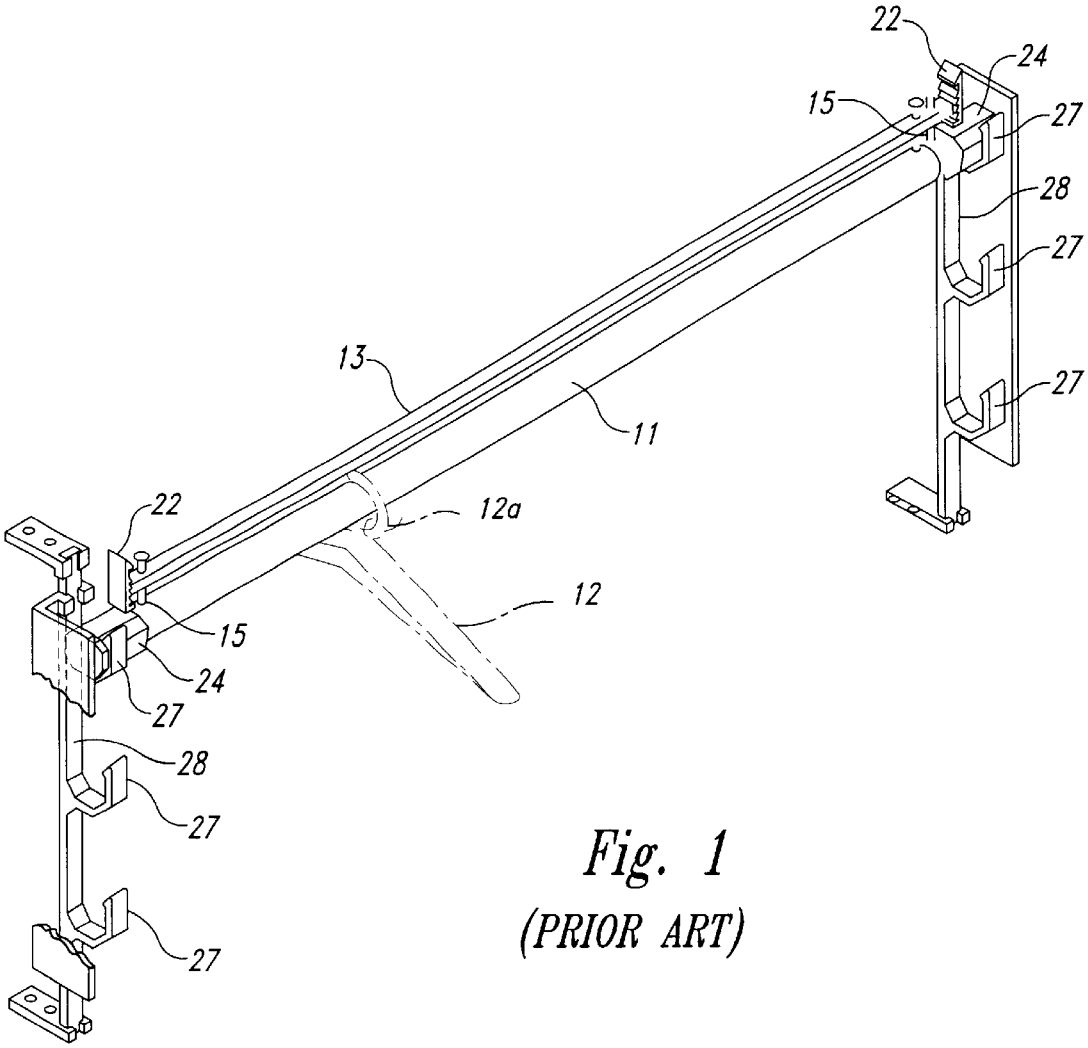
Fig. 1 (PRIOR ART)
FIG. 1 is an isometric view of a hanger storage assembly in accordance with the prior art.
Figure 2:
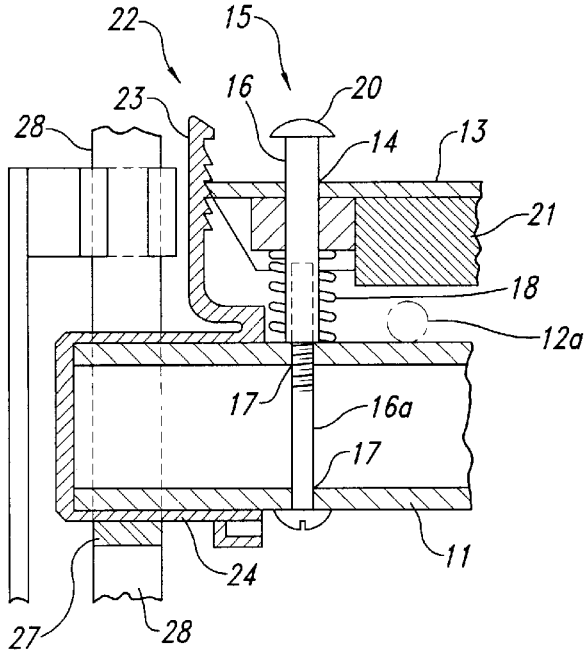
Fig. 2 (PRIOR ART)
FIG. 2 is an enlarged cross-sectional view of an end portion of the hanger storage assembly of FIG. 1.
Figure 3:
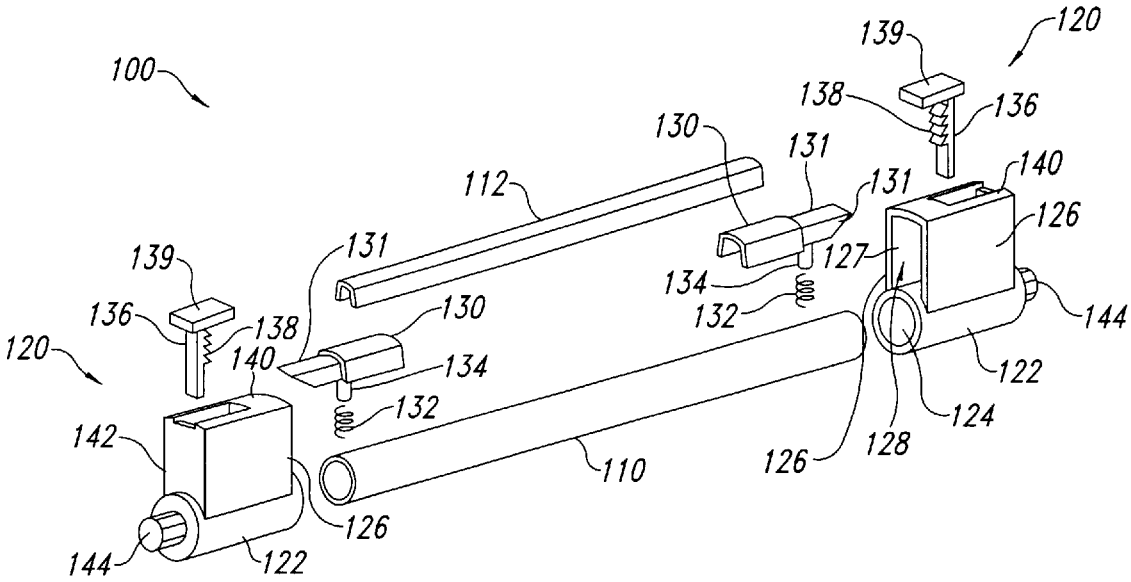
FIG. 3 is an exploded isometric view of a hanger retaining apparatus in accordance with an embodiment of the present invention.
Figure 4:
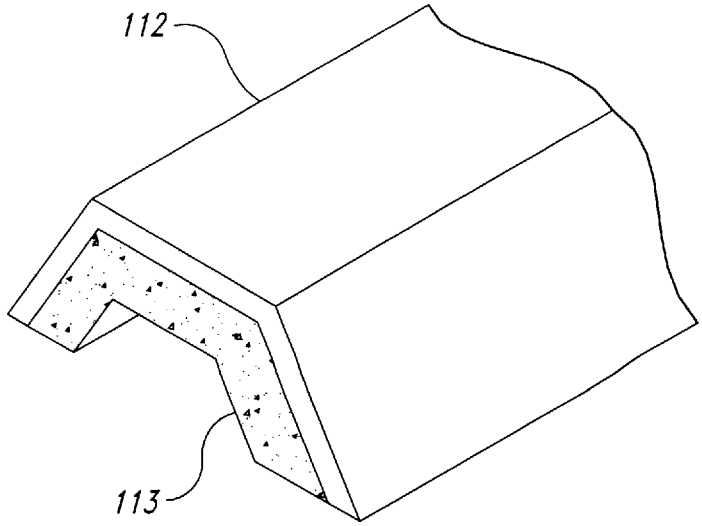
FIG. 4 is a partial isometric view of a retainer bar of FIG. 3.
Figure 5:
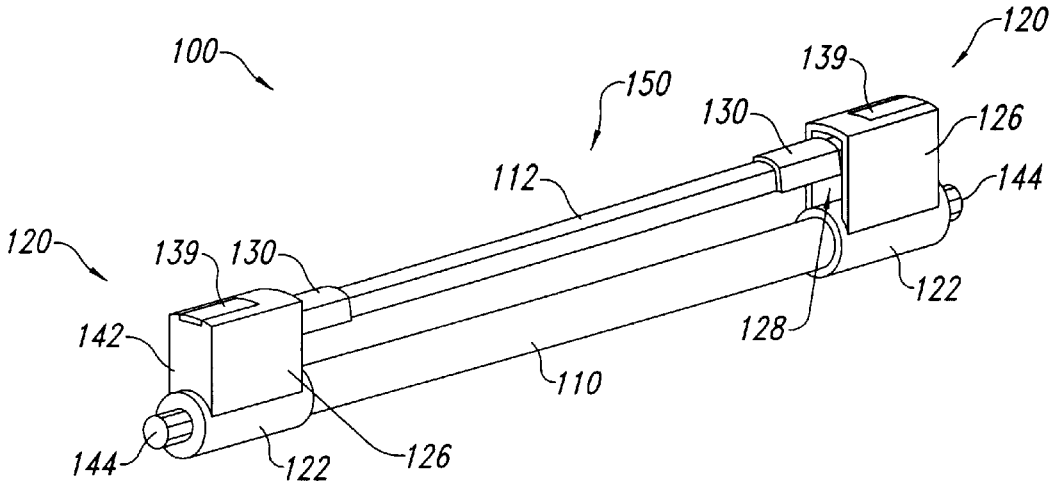
FIG. 5 is an assembled isometric view of the hanger retaining apparatus of FIG. 3 in an open position.
Figure 6:
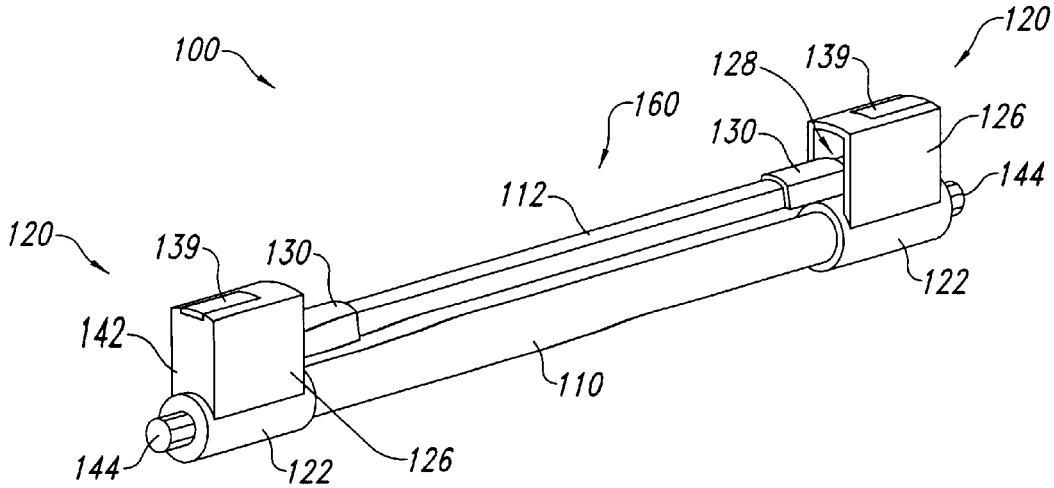
FIG. 6 is an isometric view of the hanger retaining apparatus of FIG. 5 in a clamping position.

FIG. 3 shows an exploded isometric view of an embodiment of a hanger retaining apparatus 100 for retaining a plurality of garment hangers in accordance with the invention. The hanger retaining apparatus 100 includes a hanger bar 110 for supporting a plurality of hanger hooks (not shown) and a retainer bar 112. The hanger bar 110 is preferably made of substantially rigid metal tubing cut to a desired length. The retainer bar 112 is preferably made from substantially rigid, formed metal. As shown in FIG. 4, the retainer bar 112 has a flattened or widened concave shape with a strip of resilient, compressible material 113 therein. The retainer bar 112 is moveable between an open position 150 away from the hanger bar 110 (shown in FIG. 5) and a clamping position 160 near to the hanger bar 110 for clamping the hooks to the hanger bar 110 (shown in FIG. 6).

An end assembly 120 having a main body 122 is connected to each end of the hanger bar 110. The hanger bar 110 is closely received in an orifice 124 in the main body 122 of the end assembly 120 and is frictionally retained therein. A pair of juxtaposed guide walls 126 project from the main body 122 to form a guide channel 128 therebetween. Each guide wall 126 has an inner surface 127 (shown in FIG. 3) that is preferably smooth, and the inner surfaces 127 are preferably substantially parallel. A coupling member 130 is coupled to each end of the retainer bar 112, forming an extension of the retainer bar 112, and is slideably disposed within the guide channel 128 for movement toward and away from the hanger bar 110. Each coupling member 130 has lateral surfaces 131 (shown in FIG. 3) that slideably engage the inner surfaces 127 of the guide walls 126. The dimensions of the lateral surfaces 127 and the tolerances between the lateral surfaces 131 and the inner surfaces 127 are controlled to permit the coupling member 130 to slide within the guide channel 128 but preferably to not allow the coupling member 130 to rotate, twist, bind, or otherwise jam between the guide walls 126.

A biasing spring 132 is disposed between the coupling member 130 and the main body 122, and preferably engages a projection 134 on the coupling member 130. A latching tab 136 is preferably disposed between the guide walls 126 and preferably has a plurality of serrated surfaces 138 and a top member 139. A top wall 140 extends between the guide walls 126 at a position spaced from the main body 122, and a back wall 142 extends between the guide walls 126 near the latching tab 136. The main body 122 also preferably includes a polygonal mounting member 144.

In operation, the coupling member slideably moves along the guide channel 128, escorting the retainer bar 112 between the clamping position 160 near the hanger bar 110 and the open position 150 away from the hanger bar 110. The biasing spring 132 exerts a biasing force on the coupling member 130, urging the coupling member 130 away from the main body 122, and thus, urging the retainer bar 112 away from the hanger bar 110. The top wall 140 forms a mechanical stop to define the limit of travel of the coupling member 130 and retainer bar 112 away from the main body 122. The latching tab 136 is preferably composed of a resilient material, such as a polypropylene material or a nylon material (e.g. Zytel®), and is biased against the coupling member 130. The serrated surfaces 138 of the latching tab 136 engage the coupling member 130 and form a plurality of mechanical stops against the biasing force of the biasing spring 132, permitting the retainer bar 112 to be positioned at selected distances from the main body 122. The latching tab 136 is disengaged from the coupling member 130 by pushing the top member 139 toward the back wall 142. The back wall 142 preferably forms a mechanical stop to define the limit of travel of the latching tab 136.

The hanger retaining apparatus 100 is positioned to receive a plurality of hangers by disengaging the latching tabs 136 from the coupling members 130 by bending the latching tabs 136 toward the back walls 142, allowing the biasing springs 132 to slide the coupling members 130 along the guide channels 128 and into contact with the top walls 140. The retainer bar 112 is thereby moved into the open position 150 for loading or unloading the hangers. After the plurality of hanger hooks have been positioned on the hanger bar 110, the retainer bar 112 is pushed toward the hanger bar 110, sliding the coupling member 130 along the guide channel 128 toward the main body 122, and moving the retainer bar 112 into the clamping position 160 to engage and secure the hanger hooks. The resilient latching tab 136 secures the retainer bar 112 in the clamping position 160. The polygonal mounting members 144 may then be engaged into mounting clips to secure the hanger retaining apparatus 100 for transport or storage.

Although the retainer bar 112 shown in FIG. 3–6 has a flattened, concave cross-sectional shape, a variety of retainer bar configurations may be used, including flat bars or u-shaped channel members. For some applications, it is preferable to eliminate the resilient strip 113 from the retainer bar 112. Also, it is possible to operate the hanger retaining apparatus 100 without the biasing spring 132 by simply raising and lowering the retainer bar 112 by hand. For ease of operation, however, it is preferable to have at least one biasing spring 132 or other biasing device to urge the retainer bar 112 away from the hanger bar 110 when the latching tabs 136 are disengaged so that the hanger retaining apparatus 100 may be operated by an operator with one hand while the operator's other hand is handling hangers. Different types of biasing devices other than coil springs may be employed.

One may note that the coupling members 130 may be eliminated from the hanger retaining apparatus 100 so that the latching tabs 136 are biased directly against the ends of the retainer bar 112. In that case, the serrated surfaces 138 of the latching tab 136 would directly engage and secure the ends of the retainer bar 112 to position the retainer bar 112 at various distances from the hanger bar 110. In the alternative, the coupling members 130 may be constructed as an integral part of the retainer bar 112 in order to eliminate the coupling members 130 as a separate component of the hanger retaining apparatus 100.

Similarly, the latching tab 136 does not need to have the plurality of serrated surfaces 138 for engaging and securing the coupling member 130. For some applications, such as when a uniform set of hangers is to be secured, only a single latching surface is needed to secure the retainer bar 112 in the position near the hanger bar 110. Only a single latching surface may be necessary when the thickness and flexibility of the resilient strip 113 are properly adjusted to accommodate variations in the diameter or design of the hanger hooks. Furthermore, the latching tab 136 may not be resiliently biased against the coupling member 130, but rather may simply be pivotally attached to the end assembly 120 and engageable with the coupling member 130 by hand. For ease of operation using only one hand, it is preferable that the latching tab 136 be resiliently biased against the coupling member 130.

It is also possible to eliminate the top wall 140 and the back wall 142 of the end assembly 120. The movement of the coupling member 130 is primarily guided and controlled by the inner surfaces of the pair of juxtaposed guide walls 126 which project away from the hanger bar 110 to form the guide channel 128. The top wall 140 and the back wall 142 are not essential to the function of guiding and controlling the movement of the retainer bar 112. With the top wall 140 eliminated, the upward movement of the coupling member 130 within the guide channel 128 may be limited in other ways, such as by limiting the length of the biasing spring 132 or by adding a mechanical stop to the top of the latching tab 136. Thus, the end assembly 120 may be successfully configured without the top wall 140 or the back wall 142, and could even be further simplified into other embodiments having a pair of juxtaposed guide surfaces to form the guide channel 128.

Because the latching tab 136 of the end assembly 120 is preferably disposed between the guide walls 126, the latching tab 136 is greatly protected from accidental bumping or striking during operation. The top wall 140 and the back wall 142 also provide protection for the latching tab 136. Because the top member 139 is flush with the top wall 140 and is the only part of the latching tab 136 exposed to contact, it remains accessible to be pushed by the user for actuation of the latching tab 136, but it is less likely to be accidentally actuated than prior art devices having exposed latching members. Thus, the end assembly 120 advantageously reduces unintentional disengagement of the latching tab 136 from the coupling member 130.

Another advantage of the hanger retaining apparatus 100 is that the controllable movement of the retainer bar 112 is achieved without penetrating or modifying the hanger bar 110 or the retainer bar 112. The guide walls 126 guide the motion of the retainer bar 112 without the need for a vertical support post or other similar structure that penetrates the hanger bar 110. Because the end assembly 120 is coupled to the hanger bar 110 by simply sliding the end assembly 120 onto the hanger bar 110, no drilling or other machining of the hanger bar 110 is required. Similarly, because the movement of the retainer bar 112 is slideably guided by the guide walls 126, no drilling or machining of the retainer bar 112 for a vertical support post is necessary. The hanger retaining apparatus 100 is thereby easier and cheaper to manufacture than those prior art devices which require drilling or other machining of the hanger bar 110 or the retainer bar 112.

The manufacture of the hanger retaining apparatus 100 is further simplified because all nuts and bolts are eliminated. The end assembly 120 of the invention is preferably comprised of molded thermoplastic components which are preferably press-fit assembled. The components of the end assembly 120 can therefore be cheaply produced and assembled. The manufacture of the end assembly 120 is therefore simpler and more cost efficient compared with prior art devices because components that require threaded engagement are advantageously eliminated.

Yet another advantage of the end assembly 120 is that the back wall 142 forms a mechanical stop for the movement of the latching tab 136. The back wall 142 thereby prevents over-travel of the latching tab 136 and reduces plastic deformation and creep that typically occur in the resilient material of the latching tab 136. The useful life of the latching tab 136 is thereby extended over prior art devices that do not have such a mechanical stop. Thus, although the back wall 142 may be eliminated from the end assembly 120 as described above, the back wall 142 is preferably included because it advantageously reduces wear and breakage of the latching tab 136.

Figure 7:
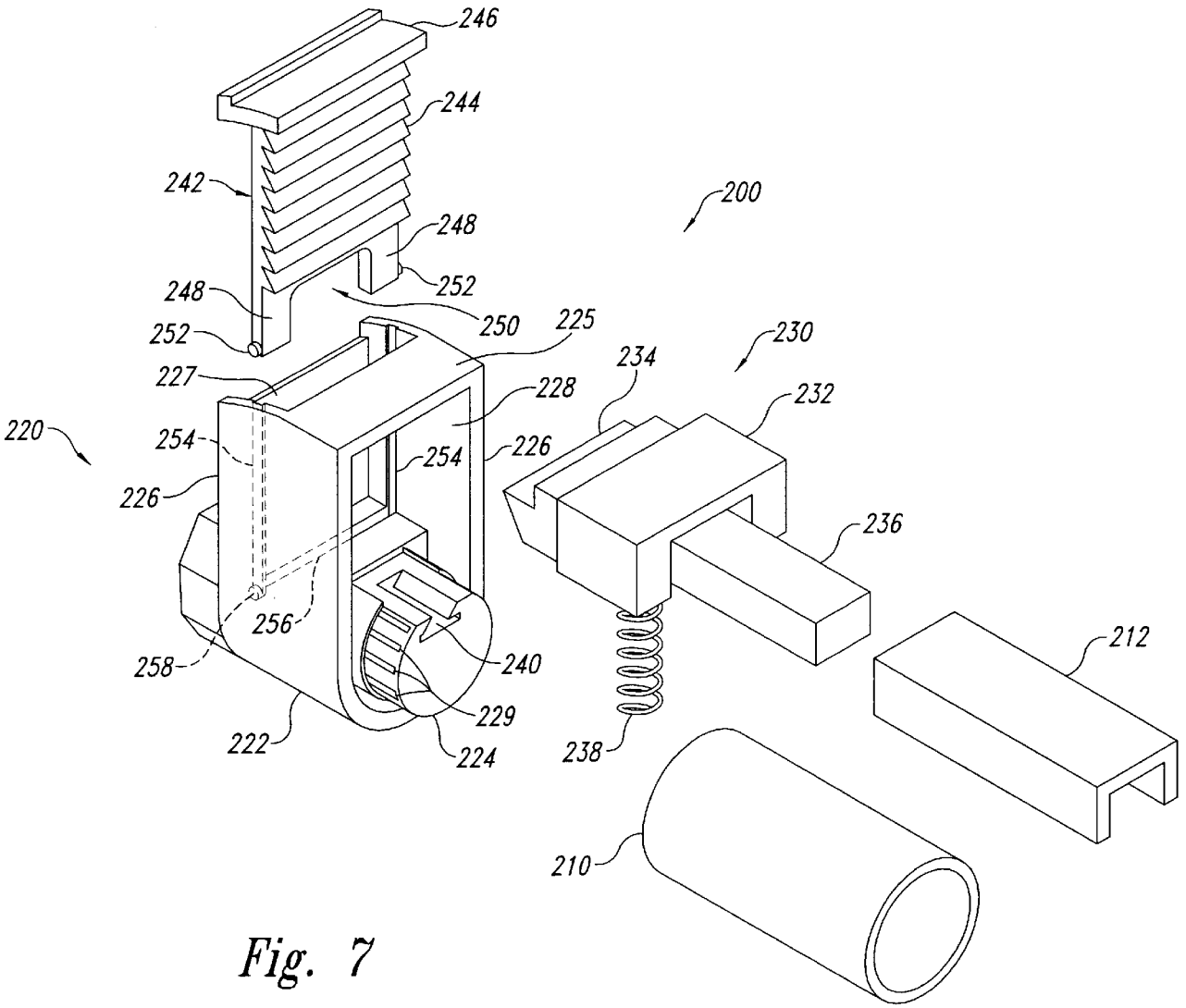
FIG. 7 is an exploded partial isometric view of an alternate embodiment of a hanger retaining apparatus in accordance with the invention.
Figure 8:
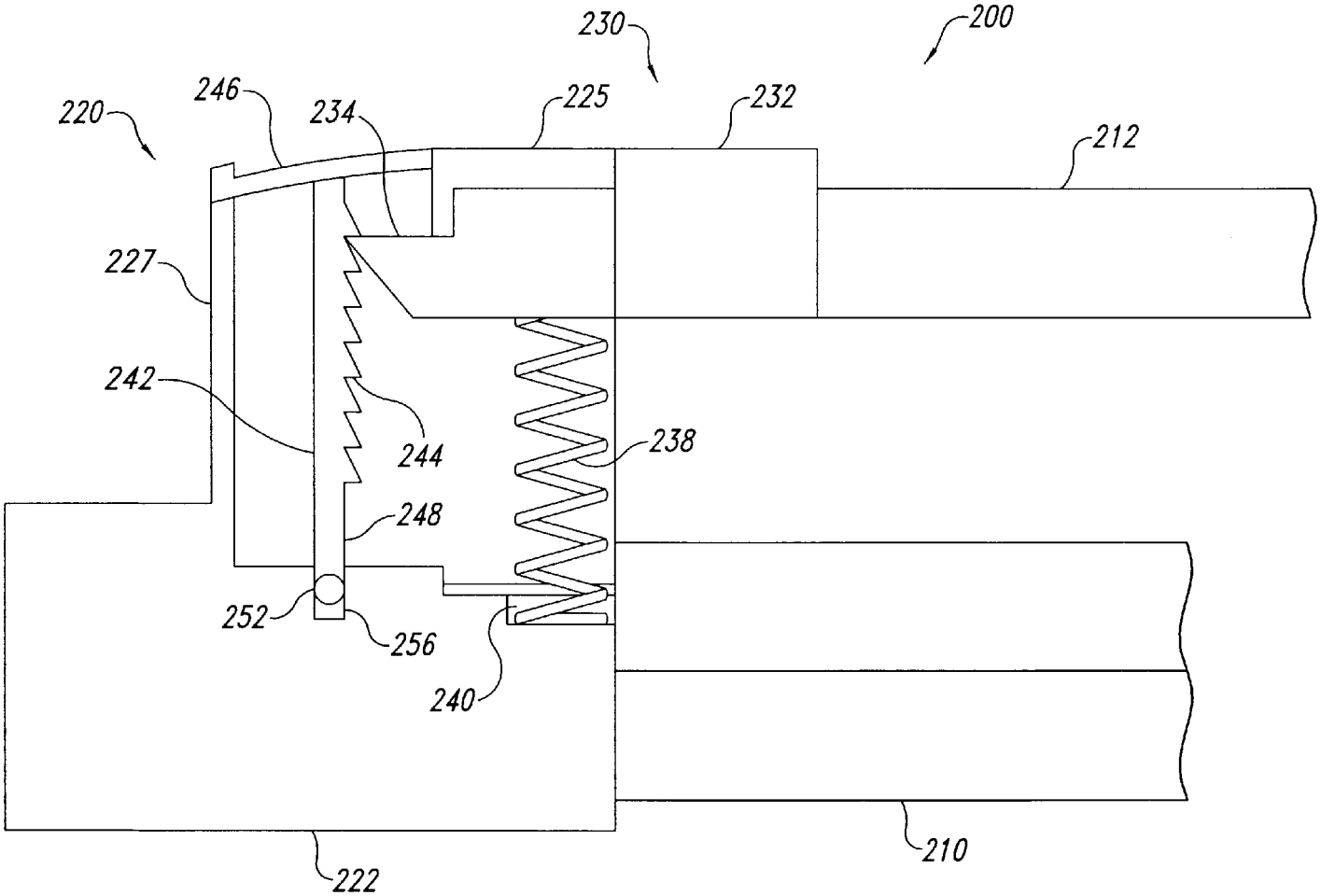
FIG. 8 is partial cross-sectional side elevation view of the hanger retaining apparatus of FIG. 7.

FIGS. 7 and 8 show an alternate embodiment of a retaining apparatus 200 in accordance with the invention. In general, this alternate embodiment and those described in this application are substantially similar to the previously described embodiments. Only significant differences in construction or operation are described in detail. In this embodiment, the hanger retaining apparatus 200 includes a hanger bar 210 and a moveable u-shaped retainer bar 212 that is guided and controlled by a pair of end assemblies 220 (only one shown) coupled to the hanger bar 210.

Each end assembly 220 includes a main body 222 having a projecting end 224 that slideably engages into the hanger bar 210, and a pair of substantially parallel juxtaposed guide walls 226 projecting away from the main body 222 to form a guide channel 228 therebetween. A top wall 225 and a back wall 227 extend between the guide walls 226. The projecting end 224 of the main body 222 includes a plurality of frangible ridges 229 circumferentially distributed thereon.

The hanger retaining apparatus 200 further includes a coupling member 230 attached to each end of the retainer bar 212 (only one shown). Each coupling member 230 includes a guide body 232 that is slideably disposed within the guide channel 228, an engagement end 234 projecting into the guide channel 228, and an attachment end 236 that is slideably attached to the retainer bar 212. The engagement end 234 is recessed inwardly from the guide walls 226 to reduce frictional contact between the guide walls 226 and the coupling member 230. A biasing spring 238 is disposed between the main body 222 and the coupling member 230, and is slideably secured into a spring channel 240 formed in the projecting end 224 of the main body 222.

A latching tab 242 having a plurality of latching surfaces 244 is disposed between the guide walls 226 of the end assembly 220. As best seen in FIG. 7, the latching tab 242 includes a top member 246 and a pair of legs 248 with a cutout 250 therebetween. A pivot pin 252 projects outwardly from each of the legs 248. An installation channel 254 is disposed on each of the guide walls 226, and a base channel 256 extending between the guide walls 226 is disposed within the main body 222. A pin receptacle 258 (only one shown in FIG. 7) is disposed within each guide wall 226 proximate the base channel 256.

During assembly, the latching tab 242 is fitted into position between the guide walls 226 by sliding the pivot pins 252 along the installation channels 254. The cutout 250 permits the legs 248 to flex inwardly so that the pivot pins 252 are squeezed slightly inwardly and slideably engage into the installation channels 254. As the legs 248 of the latching tab 242 near the main body 222, the legs 248 slide into the base channel 256 and the pivot pins 252 snap outwardly into the pin receptacles 258, securing the latching tab 242 to the guide walls 226. The latching tab 242 is thereby cantilevered out of the base channel 256. The base channel 256 is designed to bias the latching tab 242 against the engagement end 234 of the coupling member 230. The latching tab 242 is constructed of a resilient material and operates in the manner described above.

After the biasing spring 238 is slideably secured in the spring channel 240, the hanger bar 2is slideably fitted onto the projecting end 224 of the main body 222. As the hanger bar 210 engages the projecting end 224, the frangible ridges 229 are deformably crushed between the hanger bar 210 and the projecting end 224, tightly securing the end assembly 220 to the hanger bar 210. As best seen in FIG. 8, the hanger bar 210 blocks the biasing spring 238 into position in the spring channel 240.

An advantage of the end assembly 220 is that the design of the latching tab 242 facilitates installation of the latching tab 242 into the end assembly 220 and enables fine-tuning of the bending characteristics of the latching tab 242. The cutout 250 permits the legs 248 to flex inwardly, allowing the latching tab 242 to be constructed as a separate component and then assembled with the other components of the end assembly 220 quickly and inexpensively. The size of the cutout 250 contributes to the amount of force necessary to bend the latching tab 242 to disengage the serrated surfaces 244 from the engagement end 234. For a given latching tab material, for example, a larger cutout 250 results in a smaller force necessary to actuate the latching tab 242. The cutout 250 thereby facilitates assembly and provides an additional design variable for optimization of the performance of the end assembly 220.

Furthermore, the design features of the latching tab 242 enhance repairability and maintainability of the end assembly 220. The latching tab 242 is removable from the end assembly 220 by applying pressure inwardly on the pivot pins 252, causing the legs 248 to flex inwardly and forcing the pivot pins 252 out of the pin receptacles 258. In this way, worn or damaged latching tabs may be removed and replaced. Typically, when a latching tab becomes damaged or worn in prior art devices, an entire end assembly must be discarded and replaced. Thus, the enhanced repairability and maintainability of the latching tab 242 provides a considerable advantage over the prior art.

Figure 9:
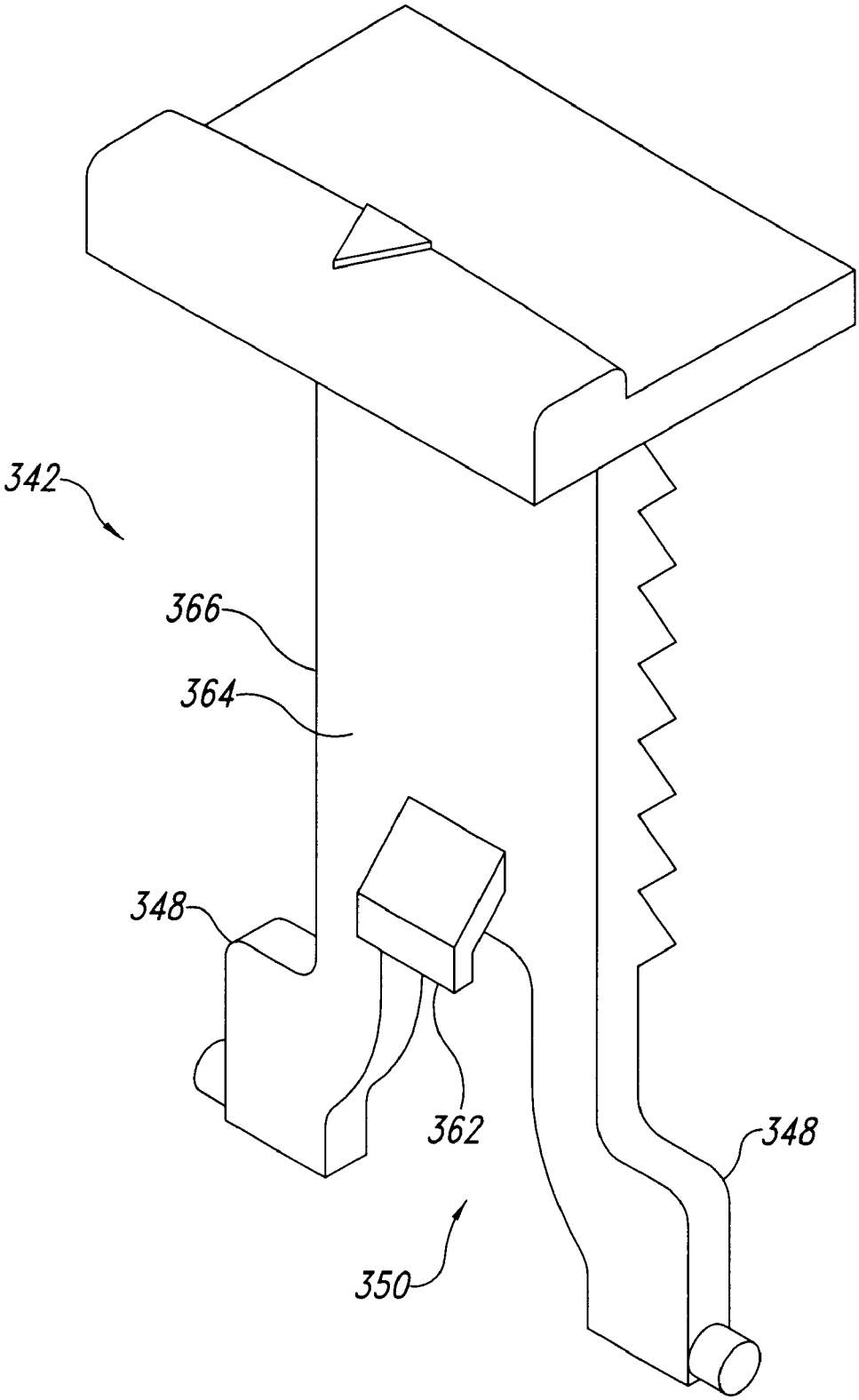
FIG. 9 is an isometric view of an alternate embodiment of a latching tab in accordance with the invention.

FIG. 9 shows an alternate embodiment of a latching tab 342 in accordance with the invention. As in the previously described embodiment, the latching tab 342 includes a pair of legs 348 and a notch 350 therebetween. In this embodiment, however, the latching tab 342 further includes a flap 362. The flap 362 projects from a back side 364 of a body portion 366 of the latching tab 342, the back side 364 facing the back wall 227 (shown in FIG. 8) of the end assembly 220.

In operation, the flap 362 contacts the main body 222 (shown in FIG. 8) and resists the movement of the latching tab 342 toward the back wall 227. The flap 362 thereby provides or contributes to the biasing force which biases the latching tab 342 against the coupling member 230 (FIG. 8), and is resistive to the bending of the latching tab 342.

An advantage of the embodiment of the latching tab 342 having the flap 362 is that the latching tab 342 does not wear out as quickly. In the previously described embodiment shown in FIGS. 7–8, the bending of the latching tab occurs in the legs 248. The flap 362, however, effectively moves the bending point of the latching tab 342 upwardly from the legs 348 to the body portion 364 of the latching tab 342. Because the body portion of flap 362 has a greater cross sectional area than the legs 348, the bending moment of the latching tab 342 is distributed over a greater area and stresses within the latching tab 342 are reduced. By reducing the stresses within the tab, the deformation and wear that results from repeated use of the tab is reduced, thereby increasing the useful life of the latching tab 342.

Although specific embodiments of, and examples for, the present invention are described herein for illustrative purposes, various equivalent modifications are possible within the scope of the invention, as will be recognized by those of ordinary skill in the art. The teachings provided herein of the present invention can be applied to other hanger retaining apparatus, and are not limited to the particular embodiments shown in the figures and described above. In general, in the following claims, the terms used should not be construed to limit the invention to the specific embodiments disclosed in the specification and the claims, but should be construed to include all hanger retaining apparatus that operate in accordance with the teachings of the invention. Accordingly, the invention is not limited by the disclosure, but instead its scope is to be determined entirely by the following claims.

What is claimed is:

1. A hanger retaining apparatus for hangers of the type including a supporting hook, comprising:

an elongated hanger bar that receives and supports the hangers;

an elongated retainer bar positionable proximate to the hanger bar to engage and secure the hooks when the hooks are interposed therebetween;

a pair of end assemblies coupled to the hanger bar, each end assembly having a main body coupled to the hanger bar and a pair of juxtaposed guide surfaces attached to the main body and projecting away from the hanger bar to form a guide channel therebetween, the retainer bar being provided with means at opposite ends thereof extending substantially parallel to the hanger bar which are slideably disposed and moveable within the guide channel for slideably locating the retainer bar between an open position away from the hanger bar and a clamping position near the hanger bar to engage and secure the hooks; and a latch mechanism connected to each end assembly, each latch mechanism being engageable with the retainer bar to secure the retainer bar in the clamping position.

2. The apparatus according to claim 1 wherein the means at opposite ends of the retainer bar includes al least two lateral surfaces that slideably engage the guide surfaces.

3. The apparatus according to claim 2 wherein the lateral surfaces are sized to substantially prevent the retainer bar from rotating between the guide surfaces.

4. The apparatus according to claim 1, further including a biasing mechanism disposed between the hanger bar and the retainer bar and urging the retainer bar away from the hanger bar.

5. The apparatus according to claim 4 wherein the biasing mechanism comprises a coil spring and the main body includes a seat, the coil spring being positioned on the seat and engaging a projection on the means at opposite ends of the retainer bar.

6. The apparatus according to claim 1 wherein at least one latch mechanism comprises a serrated member having a plurality of latching surfaces engageable with the means at opposite ends of the retainer bar at a plurality of distances from the hanger bar.

7. The apparatus according to claim 1 wherein at least one latch mechanism is resiliently biased against the means at opposite ends of the retainer bar.

8. The apparatus according to claim 1 wherein at least one latch mechanism includes a flap member that resiliently biases the latch mechanism against the means at opposite ends of the retainer bar.

9. The apparatus according to claim 1 wherein at least one end assembly includes an orifice, the hanger bar being closely received and frictionally retained in the orifice.

10. The apparatus according to claim 1 wherein at least one end assembly includes a projection, the hanger bar being slideably engaged with the projection.

11. The apparatus according to claim 10 wherein the projection includes a plurality of frangible members, the frangible members being compressed as the hanger bar is slideably engaged with the projection.

12. The apparatus according to claim 1 wherein the biasing mechanism comprises a coil spring.

13. The apparatus according to claim 1 wherein the juxtaposed guide surfaces are substantially parallel.

14. The apparatus according to claim 1 wherein at least one latch mechanism is pivotally attached to the main body of the corresponding end assembly.

15. The apparatus according to claim 1 wherein at least one latch mechanism is pivotally attached to the guide surfaces of the corresponding end assembly.

16. The apparatus according to claim 1 wherein at least one latch mechanism is at least partially disposed between the guide surfaces of the corresponding end assembly.

17. The apparatus according to claim 1 wherein the latch mechanism includes a top member engageable with the retainer bar when the means at opposite ends of the retainer bar is in the open position.

18. The apparatus according to claim 1, further comprising a top wall disposed between the guide surfaces at a position spaced apart from the main body, the top wall engageable with the means at opposite ends of the retainer bar when the retainer bar is in the open position.

19. The apparatus according to claim 1 wherein at least one end assembly includes a mounting member engageable with an external hanger structure.

20. The apparatus according to claim 19 wherein the mounting member comprises a polygonal projection extending from the main body.

21. The apparatus according to claim 1 wherein the hanger bar comprises a cylindrical member.

22. The apparatus according to claim 1 wherein the retainer bar comprises a u-shaped member.

23. The apparatus according to claim 1 wherein the retainer bar includes a resilient strip engageable with at least a portion of the hooks when the retainer bar is in the clamping position.

24. A hanger retaining apparatus for hangers of the type including a supporting hook, comprising:

an elongated hanger bar that receives and supports the hangers;

an elongated retainer bar positionable proximate to the hanger bar to engage and secure the hooks when the hooks are interposed therebetween;

a pair of end assemblies coupled to the hanger bar, each end assembly having a main body coupled to the hanger bar and a pair of juxtaposed guide surfaces attached to the main body and projecting away from the hanger bar to form a guide channel therebetween, the retainer bar being provided with coupling means at opposite ends thereof extending substantially parallel to the hanger bar which are slideably disposed and moveable within the guide channel for slideably locating the retainer bar between an open position away from the hanger bar and a clamping position near the hanger bar to engage and secure the hooks;

a latch mechanism connected to each end assembly, each latch mechanism being resiliently and disengageably biased against the coupling means and engageable with the coupling means to secure the coupling means in the clamping position; and a biasing mechanism disposed between the hanger bar and the retainer bar and urging the retainer bar away from the hanger bar.

25. The apparatus according to claim 24 wherein the coupling means includes at least two lateral surfaces that slideably engage the guide surfaces.

26. The apparatus according to claim 25 wherein the lateral surfaces are sized to substantially prevent the coupling means from rotating between the guide surfaces.

27. The apparatus according to claim 24 wherein at least one latch mechanism comprises a serrated member having a plurality of latching surfaces engageable with the coupling means at a plurality of distances from the hanger bar.

28. The apparatus according to claim 24 wherein at least one latch mechanism includes a flap member that resiliently biases the latch mechanism against the coupling means.

29. The apparatus according to claim 24 wherein at least one latch mechanism is pivotally attached to the corresponding main body.

30. The apparatus according to claim 24 wherein at least one latch mechanism is pivotally attached to the guide surfaces of the corresponding end assembly.

31. The apparatus according to claim 24 wherein at least one latch mechanism is at least partially disposed between the guide surfaces of the corresponding end assembly.

32. The apparatus according to claim 24, further comprising a top wall disposed between the guide surfaces at a position spaced apart from the main body, the top wall engageable with the coupling means when the retainer bar is in the open position.

33. The apparatus according to claim 24 wherein the retainer bar includes a resilient strip engageable with at least a portion of the hooks when the retainer bar is in the clamping position.

34. A hanger retaining apparatus for hangers of the type including a supporting hook, comprising:

an elongated hanger bar that receives and supports the hangers;

an elongated retainer bar positionable proximate to the hanger bar to engage and secure the hooks when the hooks are interposed therebetween;

a pair of coupling members attached to opposing ends of the retainer bar and extending substantially parallel thereto;

a pair of end assemblies coupled to the hanger bar, each end assembly having a main body coupled to the hanger bar and a pair of juxtaposed guide surfaces attached to the main body and projecting away from the hanger bar to form a guide channel therebetween, one of the coupling members being slideably disposed and moveable within the guide channel between an open position away from the hanger bar and a clamping position; and a latch mechanism connected to each end assembly, each latch mechanism being engageable with one of the coupling members to secure said coupling member in the clamping position.

35. The apparatus according to claim 34 wherein each coupling member includes at least two lateral surfaces that slideably engage the guide surfaces.

36. The apparatus according to claim 35 wherein the lateral surfaces are sized to substantially prevent the coupling member from rotating between the guide surfaces.

37. The apparatus according to claim 34, further including a biasing mechanism disposed between the hanger bar and the retainer bar and urging the retainer bar away from the hanger bar.

38. The apparatus according to claim 37 wherein the biasing mechanism comprises a coil spring and the main body includes a seat, the coil spring being positioned on the seat and engaging a projection on the coupling member.

39. The apparatus according to claim 34 wherein at least one latch mechanism is pivotally attached to the corresponding main body.

40. The apparatus according to claim 34 wherein at least one latch mechanism is pivotally attached to the guide surfaces of the corresponding end assembly.

41. The apparatus according to claim 34 wherein at least one latch mechanism is at least partially disposed between the guide surfaces of the corresponding end assembly.

42. The apparatus according to claim 34, further comprising a top wall disposed between the guide surfaces at a position spaced apart from the main body, the top wall engageable with the coupling member when the coupling member is in the open position.

43. The apparatus according to claim 34 wherein at least one latch mechanism comprises a serrated member having a plurality of latching surfaces engageable with the coupling member at a plurality of distances from the hanger bar.

44. The apparatus according to claim 34 wherein at least one latch mechanism is resiliently biased against the coupling member.

45. The apparatus according to claim 34 wherein at least one latch mechanism includes a flap member that resiliently biases the latch mechanism against the coupling member.

46. A hanger retaining apparatus for hangers of the type including a supporting hook, comprising:

an elongated hanger member that receives and supports the hangers;

an elongated retainer member positionable proximate to the hanger member to engage and secure the hooks when the hooks are interposed therebetween;

guide channel means connected to each end of the hanger member and extending substantially parallel thereto for slideably guiding the retainer member between a clamping position near the hanger member and an open position away from the hanger member;

latching means connected to each guide surface means for securably and releasably engaging the retainer member in the clamping position; and biasing means for urging the retainer member away from the hanger member when the latching means is not engaged.

47. The apparatus according to claim 46 wherein the latching means comprises a serrated member pivotally attached to the guide surface means, the serrated member having a plurality of latching surfaces engageable with the retainer member at a plurality of distances from the hanger member.

48. The apparatus according to claim 46 wherein the biasing means comprises a coil spring disposed between the hanger member and the retainer member.

49. The apparatus according to claim 46 wherein the guide channel means comprises a main body attached to a pair of juxtaposed guide walls and slideably coupled with the hanger member.

* * * * *

UNITED STATES PATENT AND TRADEMARK OFFICE

CERTIFICATE OF CORRECTION

PATENT NO. : 6,223,915 B1
DATED : May 1, 2001
INVENTOR(S) : John Waner

It is certified that error appears in the above-identified patent and that said Letters Patent is hereby corrected as shown below:

Claim 2, column 8,
Line 56, "includes al least two" should read -- includes at least two --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*